US011192774B2

(12) United States Patent
Tartler

(10) Patent No.: US 11,192,774 B2
(45) Date of Patent: Dec. 7, 2021

(54) DEVICE FOR EVACUATING A CONTAINER HAVING PASTY LIQUID

(71) Applicant: Udo Tartler, Luetzelbach/Haingrund (DE)

(72) Inventor: Udo Tartler, Luetzelbach/Haingrund (DE)

( * ) Notice: Subject to any disclaimer, the term of this patent is extended or adjusted under 35 U.S.C. 154(b) by 57 days.

(21) Appl. No.: 16/494,181

(22) PCT Filed: Mar. 15, 2018

(86) PCT No.: PCT/EP2018/056518
§ 371 (c)(1),
(2) Date: Sep. 13, 2019

(87) PCT Pub. No.: WO2018/167205
PCT Pub. Date: Sep. 20, 2018

(65) Prior Publication Data

US 2020/0017353 A1 Jan. 16, 2020

(30) Foreign Application Priority Data

Mar. 15, 2017 (DE) ..... 102017105533.9

(51) Int. Cl.
*B67D 7/02* (2010.01)
*B67C 9/00* (2006.01)
*B67D 7/64* (2010.01)

(52) U.S. Cl.
CPC ..... *B67D 7/645* (2013.01); *B67C 9/00* (2013.01); *B67D 7/0227* (2013.01)

(58) Field of Classification Search
CPC ..... B67D 7/645; B67D 7/0227; B67D 7/02; B67D 7/0283; B67D 7/0277; B67C 9/00;
(Continued)

(56) References Cited

U.S. PATENT DOCUMENTS 3,601,285 A * 8/1971 Leger ..... B67D 7/62 222/250
5,031,673 A * 7/1991 Clusserath ..... B67C 3/2642 141/6

(Continued)

FOREIGN PATENT DOCUMENTS

CN 1265079 A 8/2000
DE 37 29 318 C2 8/1994

(Continued)

OTHER PUBLICATIONS

International Preliminary Report on Patentability for International Application No. PCT/EP2018/056518, dated Sep. 26, 2019.

(Continued)

*Primary Examiner* — Marina A Tietjen
(74) *Attorney, Agent, or Firm* — Wolf, Greenfield & Sacks, P.C.

(57) ABSTRACT

A device for evacuating a container that contains a pasty liquid to avoid air inclusions or bubbles in the liquid while the container is being filled and/or to eliminate air between the liquid surface and a follower plate until the plate contacts the liquid surface during insertion of the plate into the container before removal of the liquid. The device comprises a cover assembly to close an opening of a container in a vacuum-tight manner and which has a connection device for connecting an evacuation pump. A collapse avoidance apparatus is provided to surround at least one region of the outer faces of the container walls with a seal to connect to the wall outer face in a vacuum-tight manner and form a vacuum-tight collapse avoidance chamber. A connection device is provided for connecting an evacuation pump to evacuate the chamber and apply a vacuum on the wall outer face.

9 Claims, 3 Drawing Sheets

Figure 1:
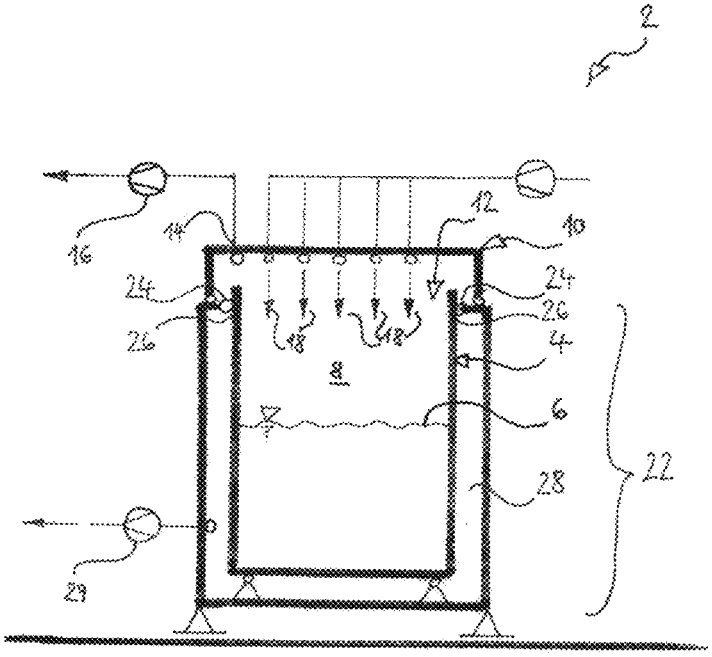

(58) Field of Classification Search
CPC .... B67C 3/06; B67C 3/10; B67C 3/12; B67C 3/24; B67C 3/242; B67C 3/32; B67C 2003/2688; B67C 2003/2691; B67C 2003/2694; B67C 2003/2697
See application file for complete search history.

(56) References Cited

U.S. PATENT DOCUMENTS

| | | | | |
|---|---|---|---|---|
| 5,240,048 | A * | 8/1993 | Diehl | B67C 3/12 141/39 |
| 6,220,310 | B1 * | 4/2001 | Emmer | B67C 3/12 141/51 |
| 6,736,172 | B1 * | 5/2004 | Chetaille | B67C 3/10 141/145 |
| 2006/0249535 | A1 * | 11/2006 | Mauger | B67D 7/0244 222/95 |
| 2008/0023082 | A1 * | 1/2008 | Schucker | B67D 7/645 137/565.17 |
| 2010/0129252 | A1 | 5/2010 | Takase | |
| 2014/0124090 | A1 * | 5/2014 | Schneider | B67D 7/0227 141/27 |

FOREIGN PATENT DOCUMENTS

| | | | | |
|---|---|---|---|---|
| DE | 19649461 | A1 * | 6/1998 | B67D 7/645 |
| DE | 19909826 | A1 * | 9/2000 | B67C 7/0073 |
| DE | 10 2007 003 972 | A1 | 7/2008 | |
| DE | 102007003972 | * | 7/2008 | |
| DE | 10 2007 003 972 | B4 | 1/2012 | |
| DE | 20 2016 003 915 | U1 | 9/2016 | |
| EP | 2 987 766 | A1 | 2/2016 | |

OTHER PUBLICATIONS

International Search Report and Written Opinion for International Application No. PCT/EP2018/056518, dated Jun. 8, 2018.

* cited by examiner

DEVICE FOR EVACUATING A CONTAINER HAVING PASTY LIQUID

CROSS-REFERENCE TO RELATED APPLICATIONS

This application is a national stage filing under 35 U.S.C. § 371 of international application PCT/EP2018/056518, filed Mar. 15, 2018, which claims priority to German application 10 2017 105 533.9, filed Mar. 15, 2017, each of which is herein incorporated by reference in its entirety.

The present invention relates to a device for evacuating a container which contains an in particular pasty liquid, and in particular for evacuating

- while the container is being filled with the liquid, in order to avoid air inclusions or bubbles in the liquid and/or
- during the insertion of a barrel follower plate into the container prior to removal of the liquid, in order to eliminate air between the material surface of the liquid contained in the barrel and the barrel follower plate until said barrel follower plate contacts the liquid surface.

It is a known process task, for example in the manufacture and processing of plastics, to convey pasty (highly viscous) materials (which are filled into cylindrical containers or barrels, typically made of sheet metal or plastic, for the purposes of storage, transport and direct removal in a dosing process) out of the barrels using pumps (typically special pumps for highly viscous liquids) in the further processing stage. This affects in particular materials that are not self-levelling, in other words are so viscous that they do not form an even, horizontal liquid surface merely as a result of their own dead weight, but it also generally affects all materials that can be conveyed directly out of the drums in the dosing process, namely as a rule all materials that can be further processed without having to be stirred or homogenised. This process uses what are known as "barrel follower plates", on which the feed pumps can be mounted. These follower plates are assemblies having cylindrical rings or plates which are inserted with a seal into the barrel, whereby namely sealing rings close the assembly tight to the barrel wall. They are inserted into the barrel (after removal of the actual barrel cover) and are provided with sealing rings which close the barrel follower plate tight to the barrel wall around the full periphery. They thus form a hermetically tight, rigid cover over the liquid and together with the barrel container enclose the liquid entirely and tightly. The barrel follower plates are then actively (guided and driven) pressed onto the material. In other known processes, they slide downwards during the removal of material as a result of their dead weight or a vacuum. To that end, the containers used in this regard are typically barrels whose interior comprises a cylindrical, in particular circular cylindrical inner contour (possibly with reinforcing longitudinal or circumferential beads), whereby the inner contour typically leads without narrowing into an outer opening of the interior, namely outwards into the barrel opening.

It may at any rate be critical for the pumping of highly viscous liquids, both on account of the quality of the pumps used for that purpose and for the dosing accuracy when pumping, that there are no, or at least only as few air inclusions as possible that are as small as possible in the liquid in particular. In processes, air in the system is a disadvantageous occurrence because, from a certain quantity and size of the air inclusions, the feed pumps are unable to compress these against the material contained in the system and/or because the air introduced leads to mixing ratio problems or even termination of the process if conveyance of the liquid, in particular dosed, is part of a precisely dosed mixing process.

The object of the invention is to create a device that is designed to eliminate air in containers having an in particular highly viscous liquid or to avoid air inclusions.

This object is achieved by a device having the features of claim 1. Preferred embodiments are indicated in the subclaims.

The device according to the invention serves to evacuate a container containing an in particular pasty liquid, in particular firstly while the container is being filled with the liquid (to remove bubbles or air inclusions therein) and/or secondly prior to the (in particularly high-precision) dosing of the liquid in a subsequent mixing process (to eliminate air above the liquid surface in the intermediate space to a barrel follower plate prior to removal for dosing). To that end, the device according to the invention is equipped with a cover assembly (in particular what is known as a barrel follower plate) which is adapted to close an opening of a container in a vacuum-tight manner and which has a connection device which is arranged on the outer face of the cover assembly and is designed for connecting an evacuation pump. By means of this evacuation pump or vacuum pump, the container interior can be placed under as great a negative pressure as possible (known as a vacuum). This can (in particular during refilling into the barrel) have the effect of sucking out air inclusions in the liquid, the more completely the greater the vacuum.

For example, the device according to the invention can be used to fill a cylindrical drum or barrel, whereby the fed liquid is poured in through a vacuum-tight cover assembly specially designed for this filling, for instance, which hermetically seals the barrel on the top side (and above the surface of the liquid in the barrel) (for instance by lying on it) in such a way that the liquid must flow through the vacuum chamber (above the surface of the liquid in the barrel). Should air be conveyed with the fed liquid, the air is immediately sucked out by means of the vacuum, and a filled barrel which cannot contain any (or at least much fewer) air inclusions in the material is thereby obtained.

This filling according to the invention can also take place through a barrel follower plate, which then, so to speak, forms the vacuum-tight cover assembly just described and is equipped with a corresponding liquid feed. After this filling the barrel follower plate is then controlled under a continuing vacuum and slowly lowered in order finally to contact the liquid surface. Faults in the following dosing removal process caused by air between the liquid surface and barrel follower plate can be avoided as follows: The liquid feed pump (which is for instance located on the follower plate) is now namely filled (by pneumatic or hydraulic cylinder or by means of electrical units) by pressing the follower plate onto the material. Material is pressed into the feed pump—and this is done without air inclusions, because evacuation already takes place both before and while the space above the liquid (through which the follower plate is lowered) is being reduced, and consequently no air is pressed into the feed pump.

Alternatively, according to a further possibility, the device according to the invention is only used for a barrel change under a vacuum, for instance in a mixing device, in which usually two liquids (one of which may well be a low-viscosity liquid, such as through a pressure vessel) can be mixed together in doses. If a barrel in such a device is to be replaced because it no longer contains sufficient liquid, air can be evacuated from the volume region above the liquid in this situation for the above reasons according to the invention: The follower plate can according to the invention be controlled under a complete vacuum and slowly lowered onto the material surface in order not to have any fault caused by air between the liquid surface and the barrel follower plate and to press liquid without air inclusions into the feed pump in the subsequent dosing and removal process.

In order to avoid, in all these various applications of the invention insofar as described, that vacuum (in particular as great as possible) not only causes the air inclusions to be sucked out of the liquid and the space above the liquid in the container but possibly also causes the container to collapse as a result of the great vacuum, the device according to the invention is also equipped with a collapse avoidance apparatus which is designed to suck outwards those regions of the outer faces of walls of the container that are at risk of collapse, and thus, so to speak, to generate a counter-vacuum against the vacuum in the container. To that end, the collapse avoidance apparatus is configured to surround at least one region of the outer faces of walls of the container by means of a seal surrounding the region. The collapse avoidance apparatus connects to the wall outer face in a vacuum-tight manner and together with the wall outer face forms a vacuum-tight collapse avoidance chamber which has a connection device which is designed for connecting an evacuation pump. This evacuation pump allows the collapse avoidance chamber thus formed to itself be placed under a vacuum, such that during the evacuation of the collapse avoidance chamber the vacuum therein also acts on the wall outer face of the container. The vacuum in the collapse avoidance chamber thus sucks the outer face of the container wall outwards and can bring about an equilibrium of forces between the outer face of the container wall and its inner face (where the vacuum acts to suck out the air or air inclusions), thereby preventing the collapse of the container.

The collapse avoidance apparatus is in particular adapted to walls of a circular cylindrical container, in particular a cylindrical sheet steel lidded barrel or cylindrical plastic drum, and preferably for regions of the outer faces of walls of the cylinder jacket surface and/or of the base of the container.

The collapse avoidance apparatus is preferably designed to stand on a level floor. It preferably has an overall vacuum-tight side wall assembly, at least the inner face of which has the form of a circular cylinder jacket surface, and an overall vacuum-tight base wall assembly. The cylinder axis is oriented preferably vertically when the collapse avoidance apparatus is set on the floor. The side wall assembly preferably has an inner diameter that is at least as great as the diameter of the circular cylindrical container to which the device is adapted, and a height that is approximately as great as the height of the circular cylindrical container to which the device is adapted.

The vacuum-tight base wall assembly connects for example around the full periphery to the bottom edge of the side wall assembly in a vacuum-tight manner, and the top edge of the side wall assembly has a peripheral seal that is adapted to connect in a vacuum-tight manner to the wall outer face of the top edge region of a circular cylindrical container in the collapse avoidance apparatus. When configured in this manner, the collapse avoidance apparatus can cover the whole outer face of the container which is therein and allow vacuum to act on the entire cylinder jacket surface and base surface of its outer faces. Only the upper face of the circular cylindrical container, which face is typically formed as a barrel lid, remains free from the apparatus and thus accessible.

In order to be able to place the container in the apparatus, it is preferred that the side wall assembly has an in particular one-, two- or multi-leafed door which, when open, exposes an opening which extends over the entire height of the side wall assembly and the width of which is greater than the diameter of the circular cylindrical container to which the device is adapted.

In order to be able to push the container more easily into the apparatus, it is preferred that the base wall assembly has heavy-duty rollers or ball rollers on the inside.

In order to be able to use a barrel follower plate in a cylindrical container, it is preferred that the interior of the container to which the device is adapted has a cylindrical inner contour, and that the cover assembly comprises a follower plate with a seal which is arranged on a periphery of the follower plate and is adapted so as to be able to be inserted into the cylindrical inner contour of the container such that it seals around the periphery, and that the follower plate is adapted so as to be moveably guided in a translationally vertical downward manner by a guide in the direction of the cylinder axis of the thus oriented container in such a way that the follower plate can be lowered in the direction of the cylinder axis onto a liquid level (the liquid in the container). It is particularly preferred that overall the device is adapted to a container for the liquid which is a smooth-walled sheet steel lidded barrel having a clamping ring closure or a cylindrical plastic container.

These and other advantages and features of the invention are further described using the following illustrations of an exemplary embodiment of the invention.

Figure 2:
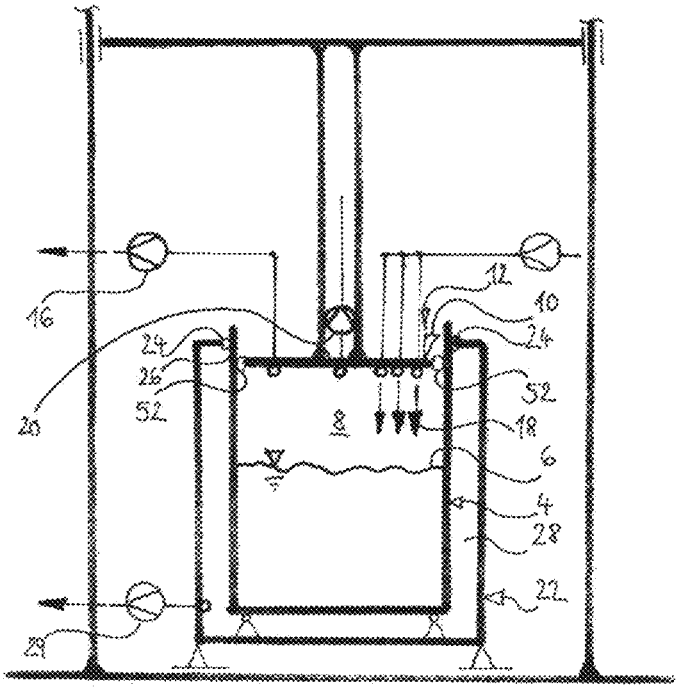
Figure 3:
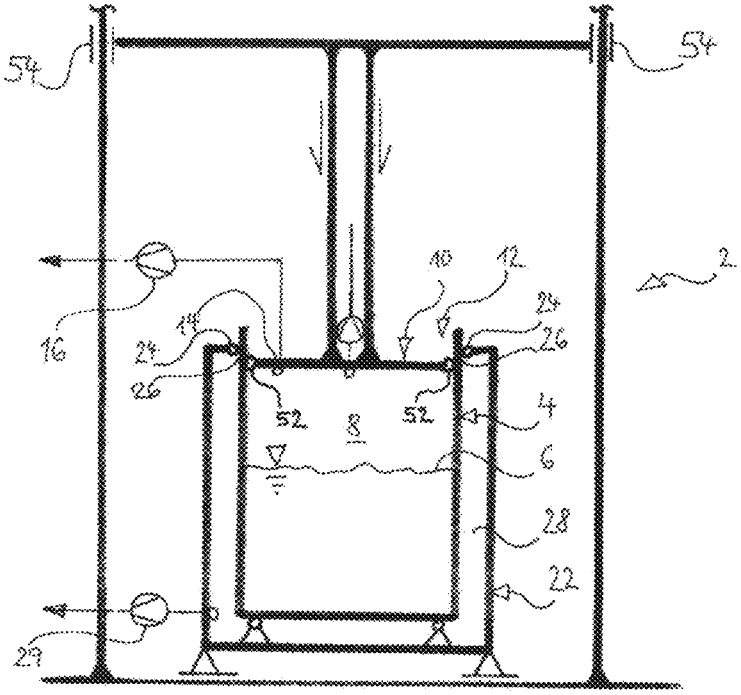
Figure 4:
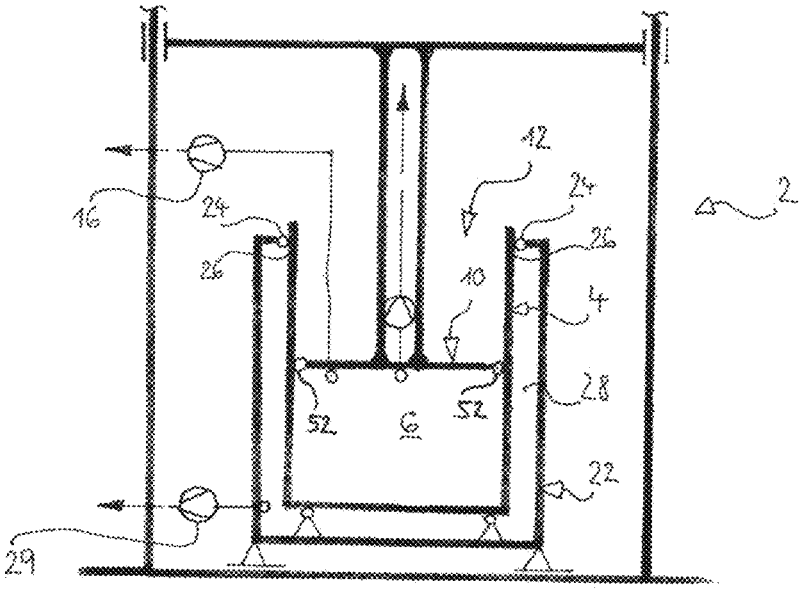
Figure 7:
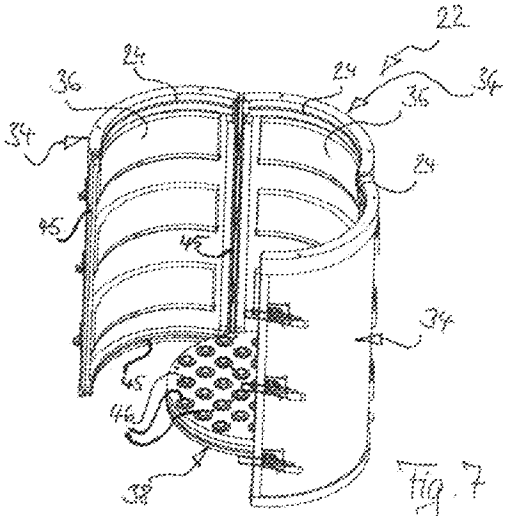
Figure 8:
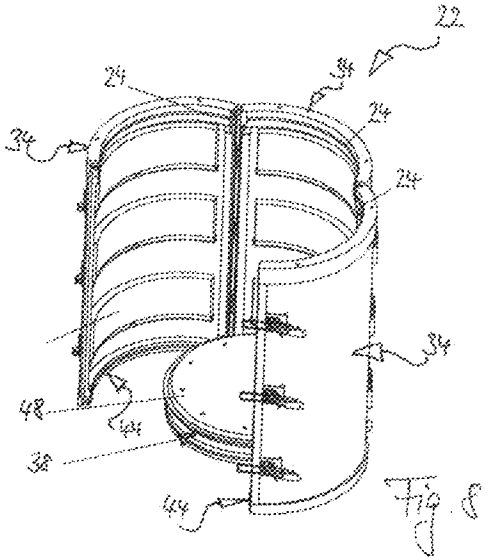
Figure 6:
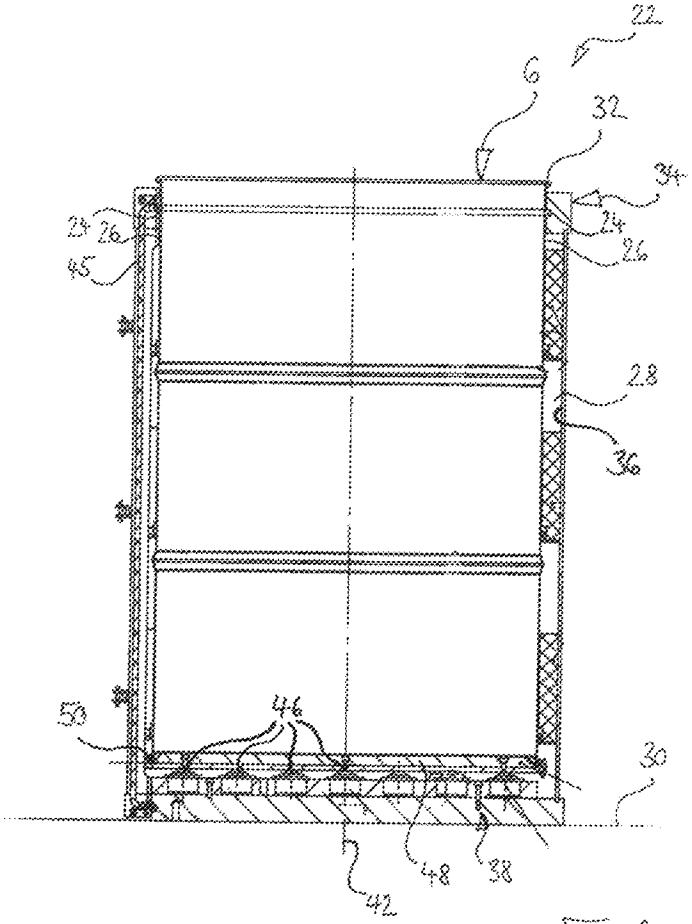
Figure 5:
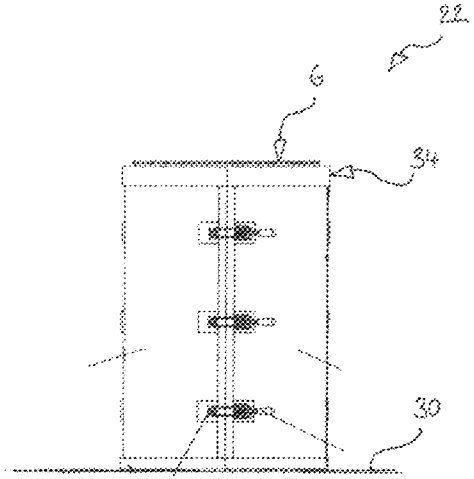

FIG. 1 shows a schematic front view of a device according to the invention during the filling of a container by means of a cover assembly specially designed for that purpose according to the invention FIG. 2 shows a schematic front view of the device according to the invention during the filling of a container by means of a barrel follower plate specially designed for that purpose according to the invention FIG. 3 shows a schematic front view of the device according to the invention during the lowering of a barrel follower plate after a change of container in a mixing machine FIG. 4 shows a schematic front view of the device according to the invention after the lowering of the barrel follower plate during the conveyance of liquid into a mixing machine FIG. 5 shows a front view of a collapse avoidance apparatus according to the invention with closed door FIG. 6 shows a cropped front view of the collapse avoidance apparatus according to the invention according to FIG. 5 with the container inserted FIG. 7 shows a three-dimensional view of the collapse avoidance apparatus without the container inserted with the door open FIG. 8 shows a three-dimensional view of the collapse avoidance apparatus without the container inserted with the door open, without the container but with the centring plate for the container inserted The illustrated device 2 serves to evacuate a circular cylindrical container 4 (illustrated in the form of a cylindrical sheet steel lidded drum 4) containing a pasty liquid 6, in particular firstly while the container is being filled with the liquid (in order to avoid bubbles or air inclusions therein; FIGS. 1 and 2) and secondly to eliminate air above the liquid surface 6 in the intermediate space 8 to a barrel follower plate 10 while said barrel follower plate is descending onto the liquid surface 6 (FIGS. 1 and 2). To that end the device 2 is equipped with a barrel follower plate 10 (FIGS. 2 to 4; or with a cover assembly specially designed only for the filling according to FIG. 1) which is adapted to seal an opening 12 on the top side of the container 4 in a vacuum-tight manner. It has a connection device 14 which is arranged on the outer face of the barrel follower plate 10 and is designed for connecting a vacuum pump 16. By means of this vacuum pump 16, the interior of the container 4 (and also the liquid 6 in the container 4) can be placed under a vacuum.

In two exemplary applications according to FIGS. 1 and 2, this brings about a sucking out of air inclusions in the liquid 18 during the filling or refilling into the barrel 4, the more completely the greater the vacuum.

The device 2 can thus be used to fill a cylindrical drum 4, whereby the fed liquid (schematically indicated by the arrows 18) is poured in through the vacuum-tight cover assembly 10 (either a cover assembly according to FIG. 1 specially designed only for filling or a barrel follower plate according to FIG. 2 specially designed for filling) which hermetically seals the barrel 4 on the top side (and above the surface 6 of the liquid 6 in the barrel) in such a manner that the liquid 18 must flow through the vacuum chamber 8 (above the surface 6 of the liquid in the barrel). Should air be conveyed with the fed liquid 18, the air is immediately sucked out by means of the vacuum (generated by the vacuum pump 16), and a filled barrel which cannot contain any (or at least significantly fewer) air inclusions in the material 6 is thereby obtained.

After this filling, the barrel follower plate 10 can then be controlled under a continuing vacuum and slowly lowered in order finally to make contact with the liquid surface 6 with its bottom side. This is also described further below (FIGS. 3 and 4).

According to a further possibility (FIGS. 3 and 4), the device 2 is namely used in barrel changes under vacuum (generated by the vacuum pump 16) in a mixing device (not shown). If in such a mixing device one of the barrels 4 is to be changed, perhaps because it no longer contains sufficient liquid, the ventilation of the volume region of the respective replaced, filled barrel 4 above the liquid 6 contained therein is achieved by means of the device 2. In this way, the follower plate 10 can namely be controlled (given the vacuum generated by the vacuum pump 16) and slowly lowered onto the material surface 6 in order for example not to obtain any fault in the following dosing removal process as a result of air between the liquid surface 6 and the barrel follower plate 10. The liquid feed pump 20 is now namely filled (by pneumatic or hydraulic cylinder or by means of electrical units; not shown) by pressing the follower plate 10 onto the material 6 in a guided manner: Material is pressed into the feed pump 20—and this is done without air inclusions, because evacuation by the vacuum pump 16 takes place both before and then while the space 8 above the liquid 6 (through which the follower plate 10 is lowered) is being reduced (FIG. 3), and consequently no air is pressed into the feed pump. In order now to avoid that the vacuum not only causes air and air inclusions to be sucked out of the liquid 6, 18 and out of the vacuum chamber 8 (above the surface 6 of the liquid 6 in the barrel 4) but possibly also causes the container 4 to collapse as a result of the great vacuum, the device 2 is also equipped with a collapse avoidance apparatus 22 which is adapted to suck outwards the outer faces of the walls of the container 4 that are at risk of collapse, and thus, so to speak, to generate a counter-vacuum against the vacuum in the container 4. To that end, the collapse avoidance apparatus 22 is adapted to surround the outer face of almost all walls of the container 4 with a seal 24 surrounding the outer face. The seal 24 of the collapse avoidance apparatus 22 is adapted to connect to the wall outer face 26 in a vacuum-tight manner and together with the wall outer face forms a vacuum-tight collapse avoidance chamber 28 which has a connection device which is designed for connecting an evacuation pump 29. The collapse avoidance chamber 28 thus formed (which surrounds the entire base 30 and the entire cylinder jacket surface up to just below the top edge 32 of the barrel 4) can itself be placed under vacuum using this evacuation pump, such that during this evacuation of the collapse avoidance chamber the vacuum therein also acts on the wall outer face of the container 4. The vacuum in the collapse avoidance chamber 28 thus sucks the outer face of the container wall 4 outwards and can bring about an equilibrium of forces between the outer face of the container wall 4 and its inner face (where the vacuum to suck out the air or air inclusions is applied), thereby preventing the collapse of the container 4.

The collapse avoidance apparatus 22 is designed to stand on a level floor 33. It has an overall vacuum-tight side wall assembly 34, the inner face 36 of which overall has the approximate contour of a circular cylinder jacket surface, and an overall vacuum-tight base wall assembly 38. Set on the floor 40 as illustrated in FIGS. 5 and 6, the cylinder axis 42 is oriented vertically. The side wall assembly 34 has an inner diameter that is slightly greater than the diameter of the container 4 to which the device is adapted, and a height that is slightly lower than the height of the container 4. When assembled, the side wall assembly 34 thus extends to just before the top edge 32 of the barrel 4 (FIG. 6).

The wall assemblies 34, 38 together forming a vacuum-tight wall connect in a vacuum-tight manner to the wall outer face 26 of the container 4 just before the top edge 32 of the container 4 by means of the seal 24: The top edge of the side wall assembly 34 has a surrounding seal 24 which is adapted to connect in a vacuum-tight manner to the wall outer face 26 of the top edge region of the circular cylindrical container 4 in the collapse avoidance apparatus 22. When configured in such a manner, the collapse avoidance apparatus 22 can cover the whole outer face of the container 4 which is therein and allow vacuum to act on the entire cylinder jacket surface and base surface of its outer faces. Only the upper face of the circular cylindrical container 4, which face is formed as a barrel opening 12, remains free from the apparatus 22 and thus accessible.

In order to be able to place the container 4 in the apparatus 22, the side wall assembly 34 has a two-leafed door 44 which, when open, exposes an opening (FIGS. 7 and 8) which extends over the entire height of the side wall assembly 34 and the width of which is greater than the diameter of the circular cylindrical container 4 to which the device 2, 22 is adapted. When closed (FIGS. 5 and 6), all joints of the door 44 are sealed by seals 45 such that overall a hermetically tight, cup-shaped trough having a circular cylindrical inner contour is obtained as collapse avoidance apparatus 22. Only its top edge is adapted to connect to the wall outer face of the container 4 in a vacuum-tight manner by means of the surrounding seal 24 just below the top edge 32 of the container 4.

In order to be able to push the container 4 more easily into the apparatus 22, the base wall assembly has heavy-duty ball rollers 46 on the inside. For centring in the collapse avoidance apparatus 22, prior to being pushed in the container 4 is placed on a centring plate 48 with which it fits positively with its bottom flange edge.

In order now to be able to use the barrel follower plate 10 in the cylindrical container 4, the follower plate has a seal 52 which is arranged on a periphery of the follower plate 10 and is adapted such that it can be inserted into the cylindrical inner contour of the container 4 such that it seals around the periphery. The follower plate is also adapted so as to be moveably guided in a translationally vertical downward manner by a guide 54 in the direction of the cylinder axis 42 of the thus oriented container 4 in such a way that the follower plate 10 can be lowered downwards onto the liquid level 6 in the container in the direction of the cylinder axis.

The invention claimed is:

1. A device configured to evacuate a container containing a pasty liquid so as to avoid air inclusions or bubbles in the liquid while the container is being filled with the liquid and/or to eliminate air between the material surface of the liquid contained in the container and a barrel follower plate until the barrel follower plate makes contact with the liquid surface during the insertion of the barrel follower plate into the container prior to removal of the liquid, the device comprising:

a cover assembly adapted to close an opening of the container in a vacuum-tight manner, the cover assembly including an outer face and a connection device arranged on the outer face of the cover assembly, the connection device configured to be connected to a first evacuation pump, and a collapse avoidance apparatus configured to surround at least one region of an outer face of a wall of the container with a seal surrounding the region, the seal adapted to contact and connect to the outer face of the wall of the container in a vacuum-tight manner and to form a vacuum-tight collapse avoidance chamber together with the outer face of the wall of the container, the vacuum-tight collapse avoidance chamber having a connection device configured to connect to a second evacuation pump such that during the evacuation of the collapse avoidance chamber the vacuum therein acts on the outer face of the wall of the container.

2. The device according to claim 1, wherein the container is a circular cylindrical container, and wherein the collapse avoidance apparatus is adapted to regions of the outer face of the wall of the circular cylindrical container.

3. The device according to claim 2, wherein the circular cylindrical container includes a cylinder jacket surface and a base, and wherein the collapse avoidance apparatus is adapted to regions of outer faces of walls of the cylinder jacket surface and/or walls the base of the container.

4. The device according to claim 2, wherein the collapse avoidance apparatus is configured to stand on a level floor and includes an overall vacuum-tight side wall assembly of the collapse avoidance chamber and an overall vacuum-tight base wall assembly which connects around the full periphery to the bottom edge of the side wall assembly in a vacuum-tight manner, the side wall assembly includes an inner face in the form of a circular cylinder jacket surface, the side wall assembly has a vertically oriented cylinder axis, an inner diameter which is at least as great as the diameter of the circular cylindrical container, and a height which is approximately as great as the height of the circular cylindrical container, the top edge of the side wall assembly has a peripheral seal which is adapted to connect in a vacuum-tight manner to the outer face of the wall of the top edge region of the circular cylindrical container in the collapse avoidance apparatus.

5. The device according to claim 4, wherein the side wall assembly has a one-, two- or multi-leafed door which, when open, exposes an opening which extends over the entire height of the side wall assembly and the width of which is greater than the diameter of the circular cylindrical container.

6. The device according to claim 4, wherein the base wall assembly has heavy-duty rollers or ball rollers on the inside.

7. The device according to claim 1, wherein the interior of the container has a cylindrical inner contour, the cover assembly including a follower plate with a seal that is arranged on a periphery of the follower plate and is adapted to be inserted into the cylindrical inner contour of the container to seal around the periphery, the follower plate is adapted to be moveably guided in a translationally vertical downward manner by a guide along a cylinder axis of the container when the container is oriented with the cylinder axis in a vertical direction, the follower plate is configured to be lowered downwards in the direction of the cylinder axis onto a liquid level of the liquid contained in the container.

8. The device according to claim 1, wherein the container is a smooth-walled cylindrical sheet steel lidded barrel or is a cylindrical plastic drum.

9. The device according to claim 2, wherein the circular cylindrical container is a sheet steel lidded barrel or a plastic drum.

* * * * *